US006098814A

United States Patent [19]

Ma

[11] Patent Number: 6,098,814

[45] Date of Patent: Aug. 8, 2000

[54] RETAINER FOR CARD EDGE CONNECTOR

[75] Inventor: Hao-Yun Ma, Tu-Chen, Taiwan

[73] Assignee: Hon Hai Precision Ind. Co., Ltd., Taipei Hsien, Taiwan

[21] Appl. No.: 09/372,397

[22] Filed: Aug. 10, 1999

[30] Foreign Application Priority Data

May 15, 1999 [TW] Taiwan ..... 88207771

[51] Int. Cl.[7] ..... A47F 7/00

[52] U.S. Cl. ..... 211/26

[58] Field of Search ..... 211/26, 41.17, 211/41.1; 361/415

[56] References Cited

U.S. PATENT DOCUMENTS

| | | | |
|---|---|---|---|
| 3,899,721 | 8/1975 | Borchard et al. | 211/41.17 |
| 4,779,744 | 10/1988 | Shely et al. | 211/41.17 |
| 4,924,354 | 5/1990 | Hermanutz et al. | 211/41.17 |
| 5,033,627 | 7/1991 | Brown | 211/26 |
| 5,044,506 | 9/1991 | Brown | 211/26 |
| 5,191,514 | 3/1993 | Kabat et al. | 211/41.17 |
| 5,533,631 | 7/1996 | Marchetti | 211/41.17 |
| 5,927,389 | 7/1999 | Gonsalves et al. | 211/26 |

*Primary Examiner*—Alvin Chin-Shue
*Assistant Examiner*—Sarah Purol
*Attorney, Agent, or Firm*—Wei Te Chung

[57] ABSTRACT

A retainer for a card edge connector comprises a dielectric body comprising an elongate cavity defined therein for receiving a daughter board, and an L-shaped actuator arm outwardly extending from the dielectric body. A pair of pressing plates upwardly extends from the side walls proximate one end of the body. Two pairs of locking latches downwardly extend from the side walls proximate opposite ends of the body. A slot is formed in each side wall for providing additional resiliency to the side walls thereby obviating the possibility of damaging of the body during assembly. When the pressing plates are actuated by a manual external force, each pair of locking latches are outwardly displaced away from each other to downwardly assemble the retainer to the connector. A cylindrical post is formed on the actuator arm for engaging with a notch formed in a daughter board inserted in the connector thereby retaining the daughter board in position. To remove the inserted daughter board, the actuator arm is rearwardly displaced by an external force to disengage the post from the notch of the daughter board.

8 Claims, 5 Drawing Sheets

RETAINER FOR CARD EDGE CONNECTOR

BACKGROUND OF THE INVENTION

The present invention relates to a retainer of a card edge connector for retaining a daughter board therein, and more particularly to a retainer for facilitating assembly to and disassembly from a card edge connector.

Description of Prior Art

To meet the ever-increasing requirements of expanding computer memory, a card edge connector is commonly used to interconnect an inserted daughter board with a mother board on which the connector mounted. A retainer for a card edge connector is provided for retaining the daughter board in the connector thereby insuring a reliable connection therebetween.

Taiwan Patent Application No. 79103934 discloses a conventional retainer in the form of a pair of latch members formed on a top surface of the daughter board. The latch members are locked into corresponding latch holes of a computer enclosure thereby retaining the daughter board in position. However, such a design is no longer used due to the miniaturization trend of computers.

A retainer typically comprising a pair of vertical arms each with a channel formed therein for retaining an edge of the daughter board is currently used. Such a retainer is assembled to a card edge connector by being mounted to a mother board. Pertinent patents are disclosed in Taiwan Patent Application Nos. 86215468 and 86219634. Referring to FIG. 1, such a conventional retainer 8 comprises a substantially U-shaped body 80 for receiving a card edge connector (not shown), a pair of fixing members 84 each forming a pair of openings 840 therein, and two pairs of nuts 86 and bolts 88. A pair of recessed arms 81 extends from opposite ends of the body 80 for retaining a daughter board (not shown) inserted into the card edge connector. A pair of U-shaped base portions 82 for receiving the nuts 86 is formed on each end of the body 80 perpendicular to the arms 81. An aperture 820 is formed in each base portion 82. When mounting the retainer 8 to a mother board 9, each bolt 88 sequentially extends through a hole 90 of the mother board 9, the opening 840 of the fixing member 84, and the aperture 820 of the base portion 82 to threadedly engage with the nut 86. Such an assembly process must be enacted four times, which is tedious and time-consuming. In addition, an external tool must be used during assembly and disassembly of the retainer 8, which is inconvenient. Furthermore, such a design compromises the integrity of the mother board due to the provision of the holes 90. Too many components are also required thereby complicating shipping and handling.

Therefore, a retainer which facilitates assembly to and disassembly from a card edge connector without compromising the integrity of a mother board or requiring an external tool, and comprising a limited number of components, is of value.

SUMMARY OF THE INVENTION

Accordingly, one object of the present invention is to provide a retainer for a card edge connector for facilitating assembly thereto and disassembly therefrom while maintaining the integrity of a mother board on which the connector is mounted.

Another object of the present invention is to provide a retainer for a card edge connector which obviates the need of an external tool during assembly.

A further object of the present invention is to provide a retainer for a card edge connector having a limited number of components thereby simplifying manufacture.

In order to achieve the objects set forth, a retainer for a card edge connector in accordance with a preferred embodiment of the present invention comprises a dielectric body and an L-shaped actuator arm outwardly extending from the body. The dielectric body comprises an elongate cavity defined therein for receiving a card edge connector, and a pair of side walls formed on opposite sides of the cavity. A pair of pressing plates each with a tab formed on an inner surface thereof vertically extends from upper surfaces of the side walls proximate one end of the body. A slot is formed in each side wall adjacent to a lower surface thereof and proximate each pressing plate for providing the body with additional resiliency thereby preventing damage thereof during assembly. Two pairs of locking latches downwardly extend from the side walls proximate opposite ends of the body.

When the pressing plates are actuated by an external manual force, the two pairs of locking latches are outwardly displaced away from each other thereby downwardly assembling the retainer to the connector. When assembled, the locking latches abut against a bottom surface of the connector and rest on a mother board on which the connector mounted. The tabs of the pressing plate and a pair of protrusions formed on the upper surfaces of the side walls abut against a top surface of the connector thereby preventing upward movement thereof. Thus, the retainer is retentively assembled to the connector without compromising the integrity of the mother board, and the assembly and disassembly of the retainer are facilitated due to the provision of the pressing plates thereby obviating the requirement of an external tool.

The actuator arm comprises a horizontal portion extending from one end of the body, a vertical portion upwardly extending from the horizontal portion, and an angled portion outwardly extending from an upper portion of the vertical portion. A cylindrical post extends from an inner surface of the horizontal portion for engaging with a corresponding notch formed in the inserted daughter board thereby retaining the daughter board in the connector. To remove the inserted daughter board, the pressing plates are actuated to disengage the post from the notch of the daughter board.

Other objects, advantages and novel features of the invention will become more apparent from the following detailed description when taken in conjunction with the accompanying drawings.

DETAILED DESCRIPTION OF THE INVENTION

Figure 1:
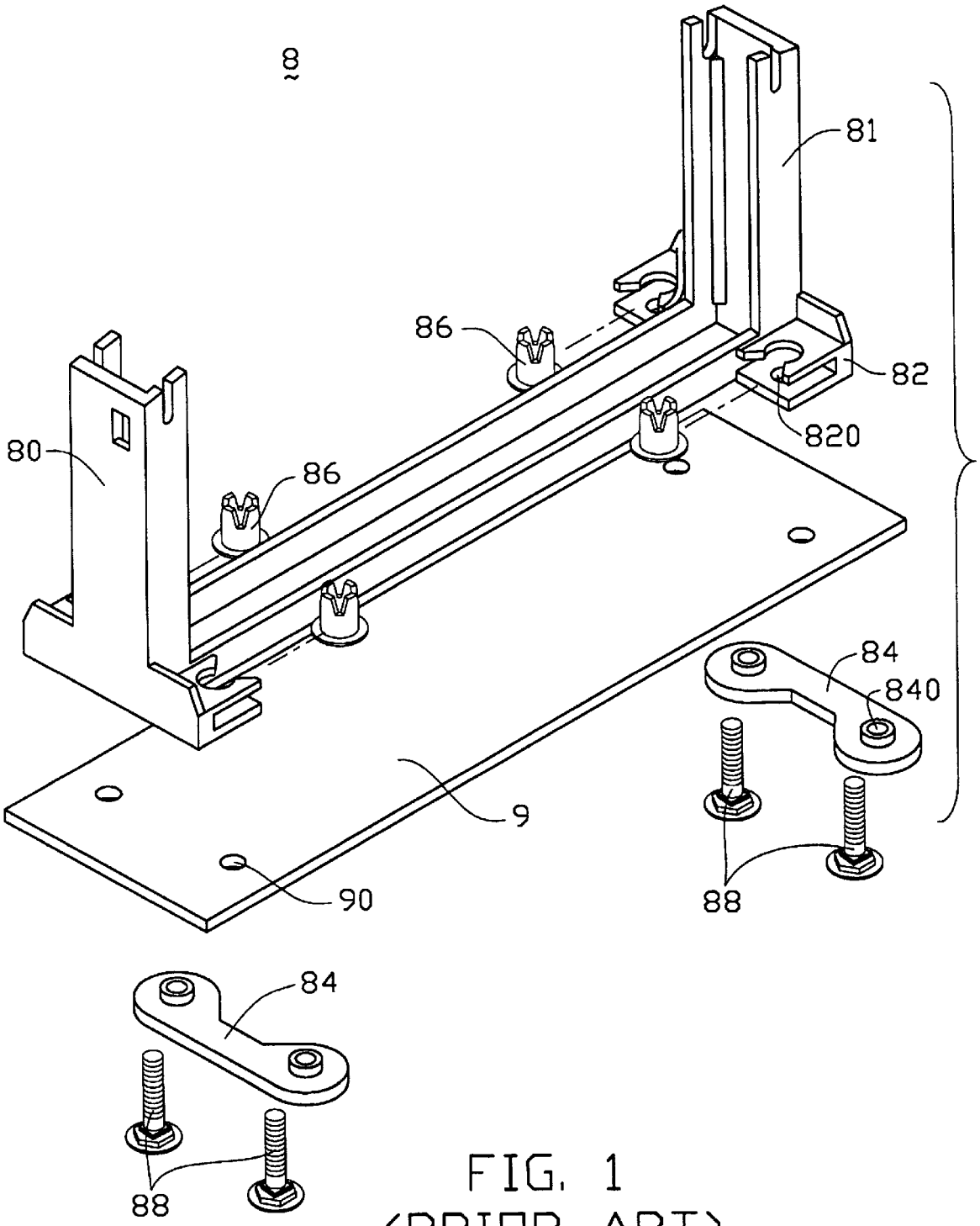
FIG. 1 (PRIOR ART)
FIG. 1 is an exploded perspective view of a conventional retainer of a card edge connector and a mother board on which the retainer is mounted.
Figure 2:
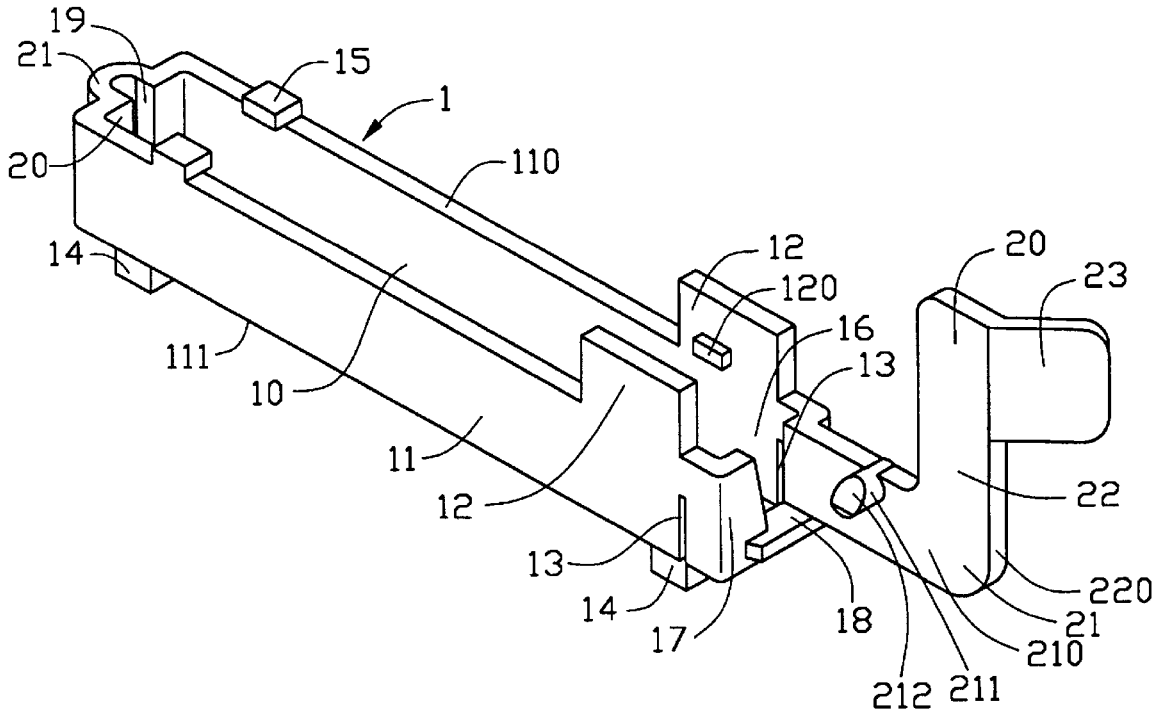
FIG. 2 is a perspective view of a retainer of a card edge connector in accordance with a preferred embodiment of the present invention.
Figure 3:
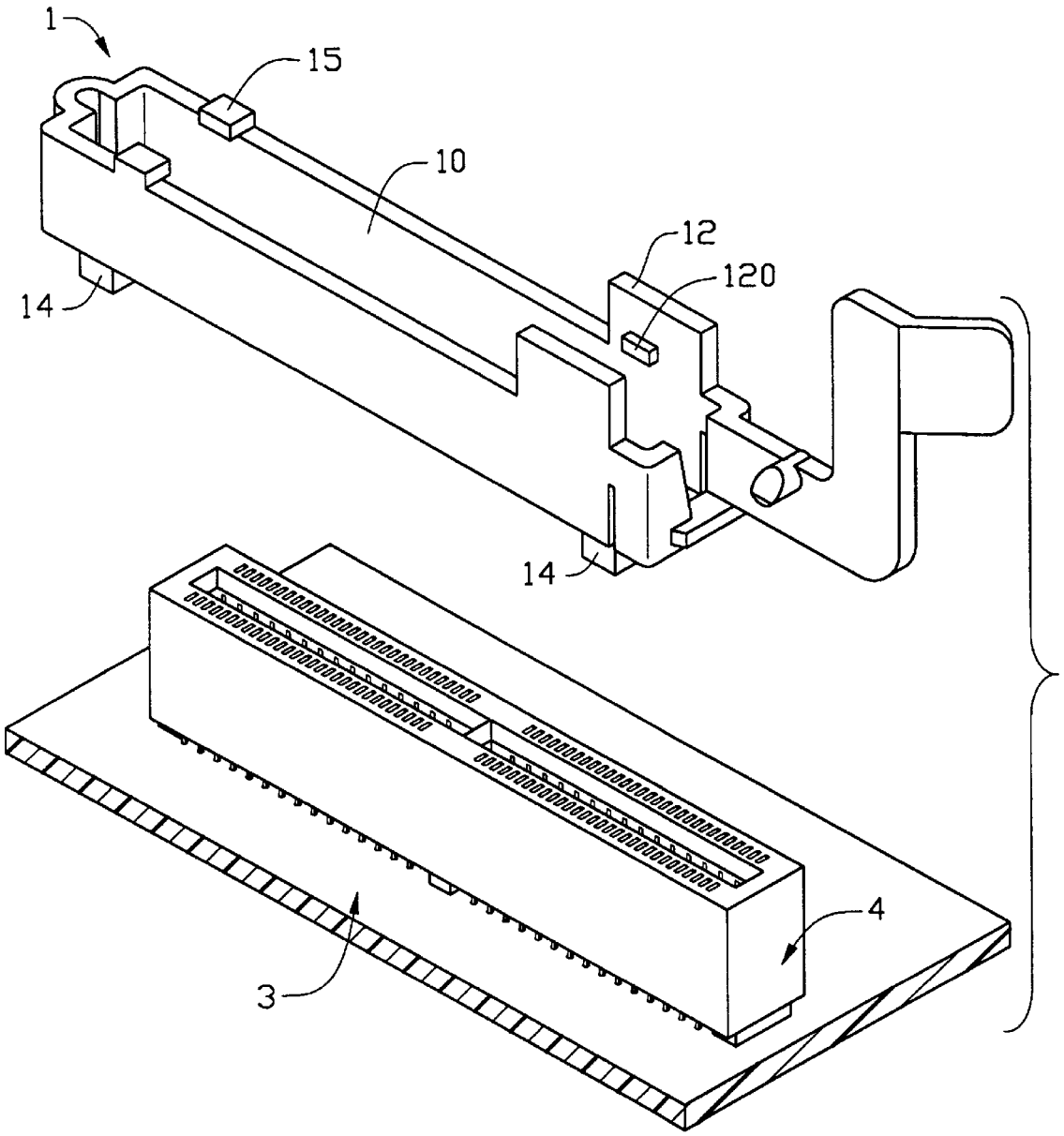
FIG. 3 is a perspective view of the retainer of FIG. 2 and the card edge connector mounted on a mother board.

Reference will now be made in detail to a preferred embodiment of the present invention. Referring firstly to FIGS. 2 and 3, a retainer 1 for a card edge connector 4 mounted on a mother board 3 is ejection molded from dielectric material, such as plastic. The retainer 1 comprises a dielectric body (not labeled) defining an elongate cavity 10 therein between a pair of opposite side walls 11 for receiving the card edge connector 4. A pair of opposite pressing plates 12 vertically extends from upper surfaces 110 of the side walls 11 proximate a first distal end of the body, the function of which will be described hereafter. A protrusion 120 extends from an inner side of each pressing plate 12 in alignment with a tab 15 inwardly extending from each side wall 11. The protrusions 120 and the tabs 15 are adapted for preventing upward movement of the connector 4 as described in detail hereinafter. A slot 13 is vertically formed in a lower surface 111 of each side wall 11 proximate each pressing plate 12. The slots 13 provide additional flexibility to the side walls 11 thereby reducing the likelihood of damaging the retainer 1. In addition, the provision of the slots 13 also reduces shrinkage of the plastic. Alternatively, each slot 13 can be formed in a horizontal or oblique direction, which serves the same function. Two pairs of locking latches 14 downwardly extend from the lower surfaces 111 of the side walls 11 proximate opposite ends of the retainer 1. A first channel 16 having a trapezoidal shape is disposed in the first distal end of the retainer 1. The first channel 16 is defined by a pair of end walls 17 interconnected by an extension plate 18 proximate the lower surfaces 111 of the side walls 11. A second channel 19 having a rectangular shape is formed in a second distal end of the body and is defined by a pair of end walls 20 with an arcuate wall 21 formed between upper portions thereof.

An L-shaped actuator arm 20 extends from one end wall 17 proximate the corresponding pressing plate 12. The actuator arm 20 comprises a horizontal portion 21 extending from the end wall 17, a vertical portion 22 upwardly extending from the horizontal portion 21, and an angled portion 23 outwardly extending from the vertical portion 22. A cylindrical post 211 extends from an inner surface 210 of the horizontal portion 21 proximate a top surface thereof. An inclined surface 212 is formed on a free end of the cylindrical post 211 for guiding a daughter board (not shown) into the cavity 10.

The retainer 1 is downwardly assembled to the card edge connector 4. The sequential assembly process is shown in detail in FIGS. 4A through 4C. Referring to FIG. 4A, a distance $d_1$, smaller than the width of the connector 4, exists between each pair of the locking latches 14 of the retainer 1 prior to assembly. Referring to FIG. 4B, during assembly, an external force F in the direction indicated by the arrows acts on the pressing plates 12 whereby each pair of the locking latches 14 is outwardly displaced to form a distance $d_2$ therebetween which is substantially equal to the width of the connector 4. The external force F is manually achieved without requiring an external tool. The expanded locking latches 14 abut against outer surfaces 41 of the connector 4. The latches 14 further slide along the outer surfaces 41 of the connector 4 until the tabs 15 and the protrusions 120 of the retainer 1 abut against a top surface 40 of the connector 4 for preventing upward movement thereof, as shown in FIG. 5.

Figure 4C:
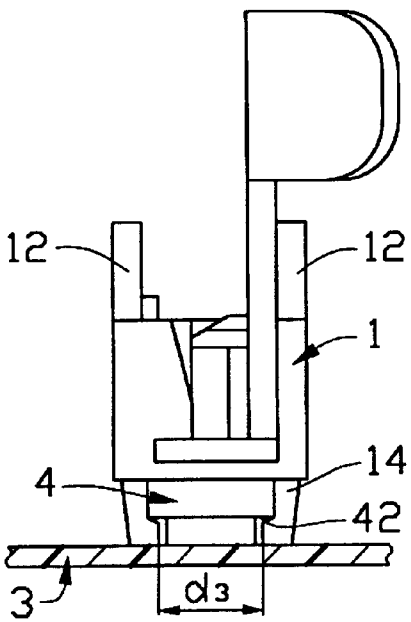
FIGS. 4A through 4C are sequential schematic side views illustrating the process of assembling the retainer to the connector.
Figure 4B:
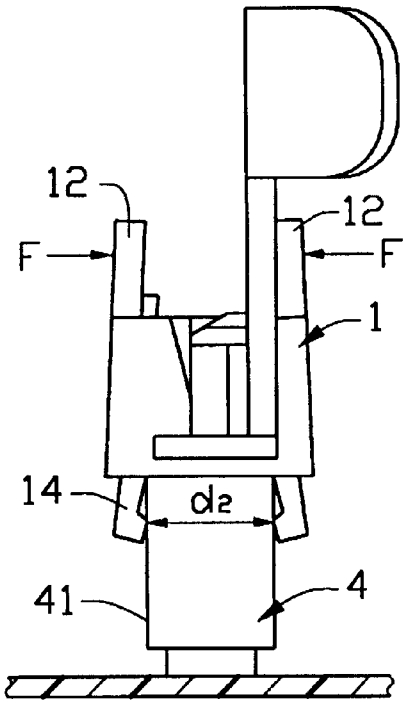
Figure 4A:
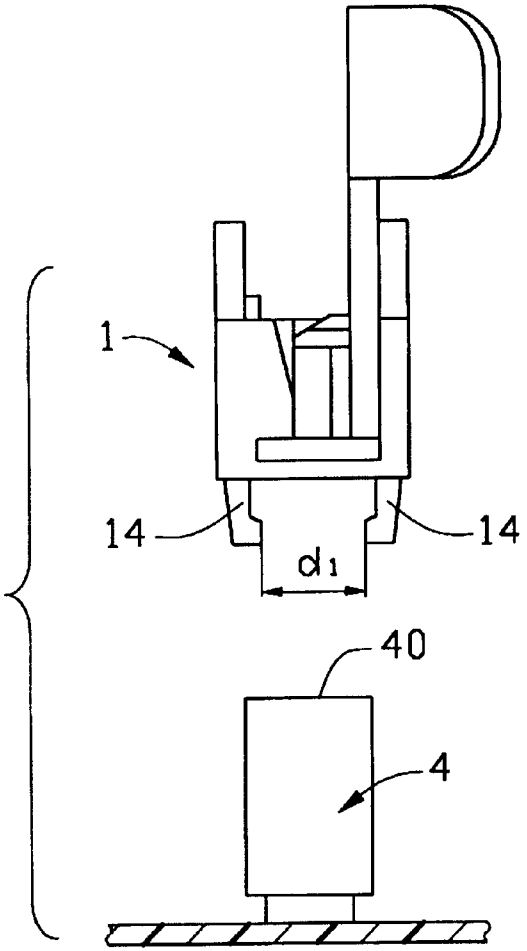

When the external force F is released from the pressing plates 12, the latches 14 resume their original shape to form a distance $d_3$ therebetween smaller than the width of the connector 4 but larger than the original distance $d_1$, as shown in FIG. 4C. The latches 14 rest on the mother board 3 and abut against a bottom surface 42 of the connector 4 to prevent downward movement thereof. Thus, the retainer 1 is retentively assembled to the connector 4 without compromising the integrity of the mother board 3.

Figure 5:
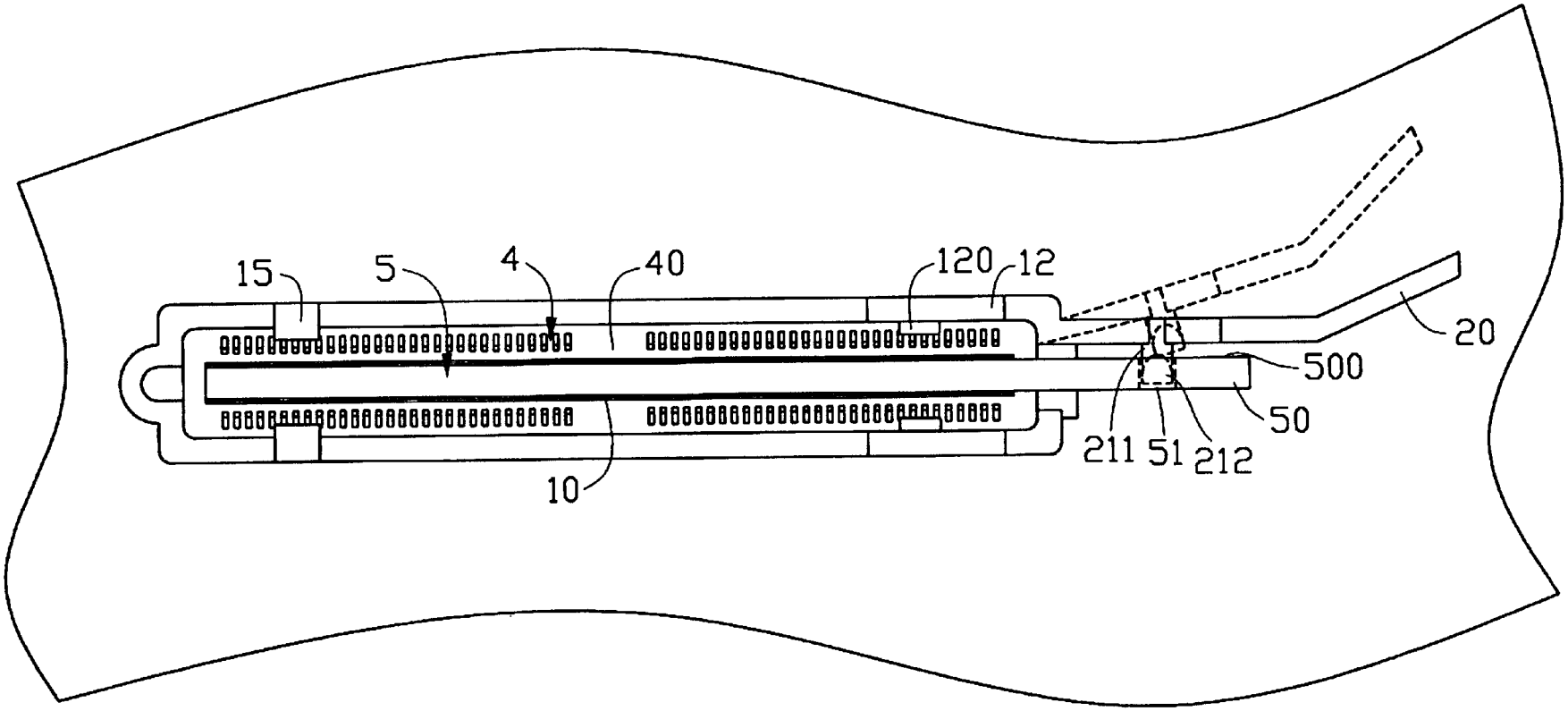
FIG. 5 is a top plan view of the assembled retainer and the connector with a daughter board inserted therein, illustrating an actuator arm of the retainer and the daughter board at a closed position in solid lines and an open position in dashed lines.

Referring to FIG. 5, when inserting a daughter board 5 into the cavity 10 of the retainer 1, a side surface 500 of an upper end portion 50 of the daughter board 5 is guided along the inclined surface 212 of the cylindrical post 211 of the actuator arm 20 whereby the actuator arm 20 is pushed rearward. The post 211 engages with a corresponding notch 51 formed in the daughter board 5 thereby preventing the daughter board 5 from being detached from the connector 4. Similarly, an external force is applied to push the actuator arm 20 rearward, as shown in dashed lines, whereby the post 211 disengages from the notch 51 of the daughter board 5 to remove the daughter board 5 from the connector 4. During the above-mentioned operation, no risk of damaging of the retainer 1 exists due to the resiliency provided by the slots 13 formed in the side walls 11 thereof.

As described above, the retainer 1 can be directly assembled to and disassembled from the card edge connector 4 by manually exerting a force on the pressing plates 12 thereof without requiring an external tool thereby facilitating assembly and reducing costs. In addition, by such an arrangement, the retainer 1 is retentively assembled to the connector 4 without compromising the integrity of the mother board 3. Furthermore, the structure of the retainer 1 is simplified thereby facilitating manufacture.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. A retainer used in a card edge connector for retaining a daughter board in the connector, comprising:

a dielectric body comprising a pair of opposite side walls, an elongate cavity defined between the side walls for receiving the card edge connector, at least one pair of locking members downwardly extending from the side walls, and a pair of pressing members upwardly extending from the side walls, the pressing members being manually operable toward each other to move each pair of locking members away from each other; and an actuator arm extending from one end of the dielectric body and forming a post on an inner surface thereof for engaging with a notch formed in the daughter board.

2. The retainer as described in claim 1, wherein each side wall comprises a slot formed proximate a lower surface thereof adjacent to associated pressing member.

3. The retainer as described in claim 2, wherein the slot is vertically formed in each side wall.

4. The retainer as described in claim 2, wherein the pressing members are formed adjacent to the actuator arm and the slots are disposed between the pressing members and the actuator arm.

5. The retainer as described in claim 1, wherein the pressing members are symmetrically formed between the two pairs of locking members proximate one pair of locking members.

6. The retainer as described in claim 1, wherein the pressing member is planar and has a tab formed on an inner surface thereof for abutting against a top surface of the connector.

7. The retainer as described in claim 1, wherein the locking members are in the form of locking latches for abutting against a bottom surface of the connector.

8. A retainer used in a card edge connector for retaining a daughter board in the connector, comprising:

a dielectric body comprising a pair of opposite side walls extending along a horizontal lengthwise direction, an elongated cavity defined between the side walls for receiving said card edge connector, at least a pair of locking members respectively extending downward from the side walls; and an actuator arm horizontally extending from one end of the body with a post thereon for engagement with a notch of the circuit board; wherein at least one slot vertically formed in one of said side walls adjacent to either said pair of locking members or the actuator arm.

* * * * *